US005111542A

United States Patent [19]

Farley

[11] Patent Number: 5,111,542

[45] Date of Patent: May 12, 1992

[54] ANATOMICALLY CONFORMABLE FOAM SUPPORT PAD

[76] Inventor: David L. Farley, 18672 Evergreen Ave., Yorba Linda, Calif. 92686

[21] Appl. No.: 725,004

[22] Filed: Jul. 2, 1991

Related U.S. Application Data

[63] Continuation-in-part of Ser. No. 411,051, Sep. 22, 1989, Pat. No. 5,010,609, which is a continuation of Ser. No. 176,925, Apr. 4, 1989, Pat. No. 4,879,776.

[51] Int. Cl.[5] ..... A47C 27/14

[52] U.S. Cl. ..... 5/464; 5/408; 5/481

[58] Field of Search ..... 5/464, 468, 481

[56] References Cited

U.S. PATENT DOCUMENTS

| | | | |
|---|---|---|---|
| 3,823,378 | 8/1974 | Flan | 5/464 |
| 4,070,719 | 1/1978 | Morgan | 5/468 X |
| 4,620,337 | 11/1986 | Williams et al. | 5/464 |
| 4,768,251 | 9/1988 | Baskent | 5/481 X |
| 4,879,776 | 11/1989 | Farley | 5/464 X |

FOREIGN PATENT DOCUMENTS

| | | | |
|---|---|---|---|
| 1559851 | 1/1980 | United Kingdom | 5/464 |

*Primary Examiner*—Michael F. Trettel
*Attorney, Agent, or Firm*—Stetina and Brunda

[57] ABSTRACT

A pad for supporting a recumbent human being comprises a substantially planar substrate formed of a resilient material and having first and second regions of lateral grooves extending substantially thereacross. The first region of lateral grooves defines a first shoulder support area and the second region of lateral grooves defines a tail support area. The remainder of the substrate defines a general support area which may have convolutions formed thereupon. A third region of lateral grooves may extend substantially across the substrate to define a second shoulder support area such that said first and second shoulder support areas are generally symmetrical with respect to the tail support area in order to facilitate of either end of the pad as a head end. A less resilient peripheral region may optionally be formed about the periphery of the pad to provide a means for helping to prevent incapacitated persons from rolling off of the pad.

12 Claims, 1 Drawing Sheet

Fig. 1
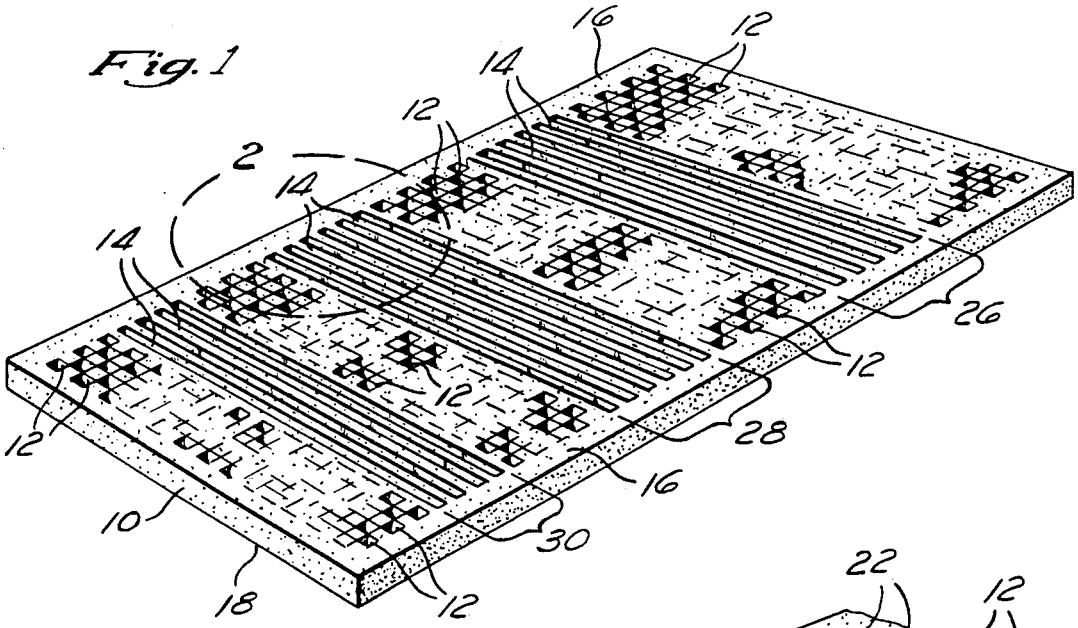
Fig. 2
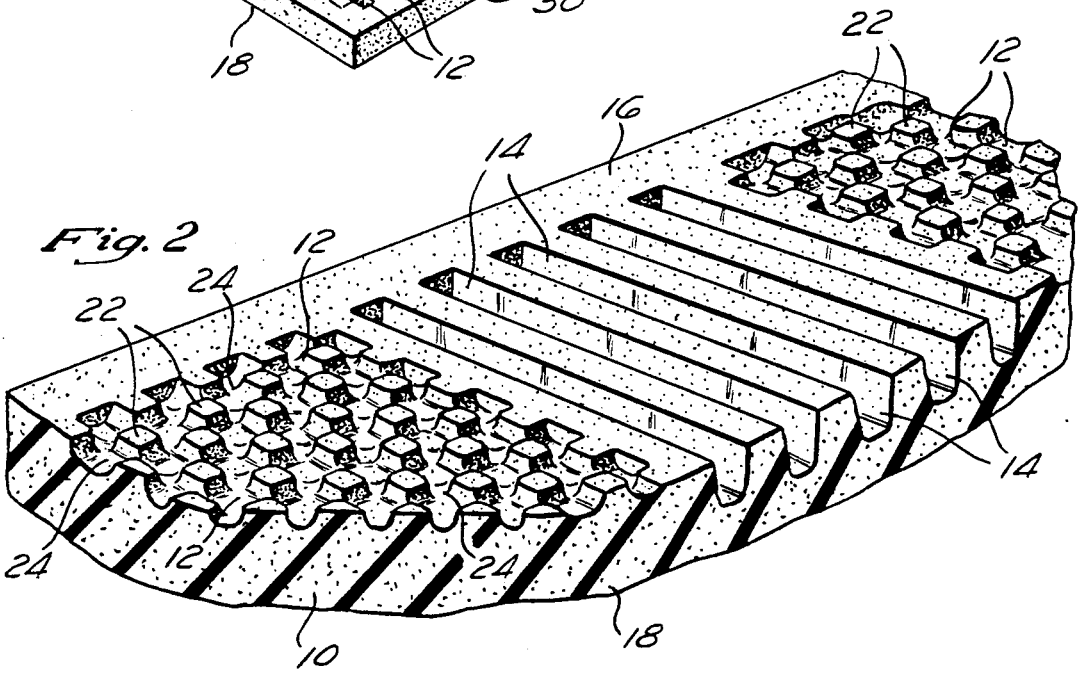
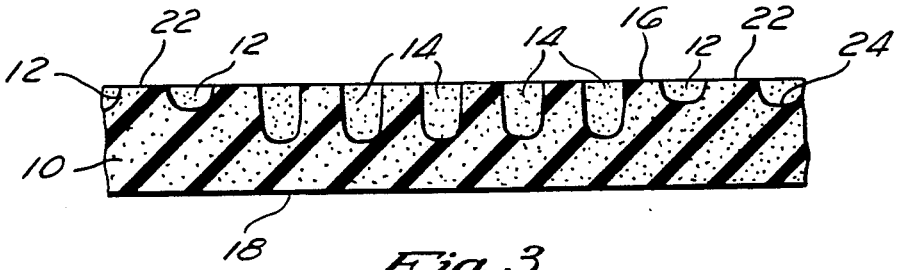
Fig. 3

ANATOMICALLY CONFORMABLE FOAM SUPPORT PAD

RELATED PATENTS

This application is a continuation-in-part of U.S. patent application 07/411,051, filed Sep. 22, 1989, now issued U.S. Pat. No. 5,010,609, which is a continuation of U.S. patent application 07/176,925, filed Apr. 4, 1989, now issued U.S. Pat. No. 4,879,776.

FIELD OF THE INVENTION

The present invention relates generally to foam pads and more particularly to a pad for supporting a recumbent human being having a first region of lateral grooves extending thereacross to define a shoulder area and having a second region of lateral grooves extending substantially thereacross to define a tail support area.

BACKGROUND OF THE INVENTION

Two of the primary causes of pressure (decubitus) ulcers are pressure and moisture. Pressure results from the supporting surface resisting the force of gravity on the body. For mattresses, this pressure is typically the highest beneath the shoulder (the scapulae) and tail (the rum and trochanter), generally the areas of greatest mass and projection. Other areas subject to substantial pressure include the ankles, heel, and portions of the feet. In these high pressure areas, the pressure against the body can be sufficient to occlude the capillaries and lymph vessels, thereby preventing the circulation of oxygen and nutrients to the skin. In addition, because air flow over these skin areas is typically prevented due to the intimate contact of the surface of the mattress, greater amounts of moisture are excreted for the dissipation of heat and waste. Over a sufficient period of time, the combination of high pressure and moisture will lead to the formation of pressure ulcers.

In an effort to combat the formation of pressure ulcers among patients, hospitals utilize a number of types of bed pads for their patients who fall into high risk categories. These products include static air, water, and foam support pads. Although these pads cannot reduce the overall resistance of the mattress to the weight of the body, they can reduce the level of pressure on the areas of highest pressure by redistributing the load and allowing a greater portion of the pad to support the body. Each of these types of pads has different advantages and disadvantages.

Generally, static air and water support pads provide superior high pressure reduction capabilities at the bony protuberances, but permit only limited air flow and heat dissipation. In addition, both static air and water support pads require filling, are susceptible to leaks and tend to "bottom out" (i.e. permit the weight of the user to displace the air or water in the pad to the extent that the user is supported by the mattress, rather than by the air or water cushion). Static water support pads also are undesirable in that they are heavy and unwieldy to transport. While pumps and valves can be used to vary the pressure resistance of the static air and water pads over time, these features render the pad both expensive and difficult to install and transport.

Convoluted foam pads, on the other hand, are generally relatively inexpensive and easily transported, while providing superior air flow potential and moisture reduction capabilities. Unfortunately, despite considerable study and effort, it has proved exceedingly difficult to develop an easily manufactured convoluted foam pad which is capable of providing pressure reduction characteristics comparable to static air and water support pads.

The manufacture of convoluted foam pads continues to largely follow the methods taught by U.S. Pat. No. 3,431,802. The pads are typically formed by feeding a foam block between two cooperating parallel cylinders, each of which has an undulated surface. The cylinders rotate towards one another and are spaced so that the block inserted between them is compressed between the cylinders and is driven against a cutting edge which slices the block in half. Each half generally comprises alternating rows of peaks and valleys, in checkerboard fashion. The resulting halves are perfectly matched so that when one half is laid upon the other, the tops of the peaks of one half rest against the floor of the valleys of the other half, thus forming a solid block. In addition, although it is possible to manufacture pads which are not the mirror image or reflection of one another, this is rarely done, as it would typically result in only one usable half, thereby significantly increasing material costs.

One convoluted foam pad currently in use is disclosed in U.S. Pat. No. 4,686,724. The pad comprises alternating columns of peaks and valleys in checkerboard fashion. Air channels are stamped, press cut or laser cut through the floor of the valleys to the bottom face of the pad, leaving removable plugs used to selectively control the amount of aeration and dissipation of body heat permitted by the pad.

In one embodiment, the peaks of the pad are "topped off" to create a broken flat surface, interposed with valleys, with the distance between the floor of each valley and the bottom surface of the pad being constant. Within each valley is a channel extending from the valley floor to the flat bottom face of the pad. The patent teaches that a skin area of 1.25 inches in diameter or less, even though denied air circulation, can sustain itself from air circulating in an adjacent area. Therefore, by limiting each peak top to a diameter of 1.25 inches or less, the occurrence of pressure ulcers can, according to the patent, be virtually eliminated. Unfortunately, the use of this uniform pad with its removable plugs has found little acceptance in practice, perhaps because the removal and replacement of the individual plugs is relatively difficult and time consuming.

Thus, it would be desirable to provide an anatomically conformable support pad wherein the shoulder and tail support regions provide improved resport to their corresponding anatomical body portions in order to mitigate the occurrence of pressure ulcers and to improve comfort.

SUMMARY OF THE INVENTION

The present invention specifically addresses and alleviates the above-mentioned deficiencies associated in the prior art. More particularly, the present invention comprises a pad for supporting a recumbent human being, the pad comprising a substantially planar substrate formed of a resilient material and having first and second regions of lateral grooves extending substantially thereacross. The first region of lateral grooves defines a first shoulder support area and the second region of lateral grooves defines a tail support area. The remainder of the substrate defines a general support area which may have convolutions formed thereupon.

A third region of lateral grooves may extend substantially across the substrate to define a second shoulder support area such that said first and second shoulder support areas are generally symmetrical with respect to the tail support area in order to facilitate use of either end of the pad as a head end. A less resilient peripheral region may optionally be formed about the periphery of the pad to provide a means for helping to prevent incapacitated persons from rolling off of the pad.

These, as well as other advantages of the present invention will be more apparent from the following description and drawings. It is understood that changes in the specific structure shown and described may be made within the scope of the claims without departing from the spirit of the invention.

BRIEF DESCRIPTION OF THE DRAWINGS

FIG. 1 is a perspective view showing the upper surface of the anatomically conformable foam pad of the present invention;

FIG. 2 is an enlarged sectional view of the anatomically conformable foam pad of FIG. 1 taken along line 2;

FIG. 3 is a cross sectional view of the anatomically conformable foam pad of FIGS. 1 and 2 showing the increased depth of the grooves in relation to the depth of the convolutions.

DETAILED DESCRIPTION OF THE PREFERRED EMBODIMENT

The detailed description set forth below in connection with the appended drawings is intended as a description of the presently preferred embodiment of the invention, and is not intended to represent the only form in which the present invention may constructed or utilized. The description sets forth the functions and sequence of steps for constructing and operating the invention in connection with the illustrated embodiment. It is to be understood, however, that the same or equivalent functions and sequences may be accomplished by different embodiments that are also intended to be encompassed within the spirit and scope of the invention.

The anatomically conformable foam pad of the present invention is illustrated in FIGS. 1—3 which depict a presently preferred embodiment of the invention. Referring now to FIG. 1, the anatomically conformable foam pad of the present invention is comprised generally of a planar substrate 10 having convolutions !2 and grooves 14 formed upon the upper surface !6 thereof. The lower surface 18 is preferably flat, i.e. not having convolutions or grooves formed therein. However, those skilled in the art will recognize that both surfaces of the planar substrate 10 may have convolutions and/or grooves formed therein. A comparatively rigid peripheral region in which no convolutions or grooves are formed substantially surrounds the remainder of the pad to provide a relatively firm border thereto.

Referring now to FIGS. 2 and 3, the convolutions 12 may be formed to have flat upper surfaces 22 to provide increased contact to those anatomical body portions not normally sinking deeply into the pad, e.g. the waist and neck area.

The formation of convolutions to provide support to specific anatomical regions is covered in detail in Applicant's issued U.S. Pat. No. 4,879,776, the contents of which are hereby expressly incorporated by reference.

The grooves 14 in the preferred embodiment of the present invention are formed to be substantially deeper than the valleys 24 formed between the peaks of the convolutions 12. Those skilled in the art will recognize that grooves having various other depths, i.e. greater than, less than, or equal to the depths of the valleys between the peaks of the convolutions 22, may likewise be suitable.

For given identical depth of grooves 14 and valleys 24 between convolution peaks 22, the grooves inherently contain less foam material per unit volume and are thus more resilient. Thus, grooves of a given depth provide more support to bony protuberant areas of the human anatomy.

Referring back to FIG. 1, the grooves 14 are thus disposed to define a first shoulder region 26, and a tail region 28. A second shoulder region 30 may be formed such that the first 26 and second 30 shoulder regions are disposed symmetrically about the tail region 28 to facilitate the use of either shoulder region 26 or 30 at the head of a bed.

The anatomically conformable foam pad of the present invention is preferably formed to have a first shoulder support area 26 which is approximately 13 inches wide and begins approximately 11.5 inches from the edge of the pad. The tail support area 28 is preferably approximately 11 inches wide and is preferably approximately 9 inches from the first shoulder support area 26. Being symmetrical, the second shoulder support area 30 is likewise preferably 13 inches wide and approximately 11.5 inches from the opposite edge of the pad.

A relatively rigid peripheral region may be formed about the periphery of the pad to provide an area of reduced resilience. This comparatively rigid peripheral region serves to maintain a recumbent human being upon the pad by providing an area of increased resistance to rolling. That is, the comparatively rigid peripheral region is substantially more difficult to roll over than the remaining portion of the mattress pad. Thus, the comparatively rigid peripheral region tends to maintain the positioning of a person disposed thereupon. This is particularly useful in those applications wherein an incapacitated person or infant is disposed upon the pad.

The anatomically conformable foam support pad of the present invention is preferably formed of a polyurethane foam having a density of between one and three pounds per cubic foot.

It is understood that the exemplary anatomically conformable foam pad described herein and shown in the drawings represents only a presently preferred embodiment of the invention. Indeed, various modifications and additions may be made to such embodiment without departing from the spirit and scope of the invention. For example, various configurations other than convolutions may utilized in the general area. Indeed, a simple flat surface would serve to provide the necessary difference in resiliency to permit adequate functioning of the grooves to provide improved support of the protuberant bony areas of a human being. Additionally, the grooves need not be aligned laterally, but rather may extend longitudinally across the desired areas. However, such longitudinal grooves result in reduced resiliency because of the nearby attachment of the ends of the ridges of the grooves to the adjoining pad sections, thus increasing the stiffness thereof in much the same manner as a suspension bridge is supported. Thus, the grooves preferably extend laterally across the pad to optimize the support provided to bony protuberant portions of the human anatomy.

Thus, these and other modifications and additions may be obvious to those skilled in the art and may be implemented to adapt the present invention in a variety of different applications.

What is claimed is:

1. A pad for supporting a recumbent human being comprising:

(a) a substantially planar substrate comprised of a resilient material;

(b) a first region of grooves extending laterally substantially across said substrate, said first region defining a first shoulder support area;

(c) a second region of grooves extending laterally substantially across said substrate, said second region defining a tail support area; and (d) wherein the remainder of said resilient substrate defines a general support area, the quantity of resilient material per unit volume in the general support area being greater than the quantity per unit volume in the shoulder and tail support areas.

2. The pad as recited in claim 1 wherein said general support area comprises convolutions.

3. The pad as recited in claim 3 further comprising a peripheral region formed about the periphery of said pad, the quantity of resilient material per unit volume on said peripheral region being greater than the quantity of resilient material per unit volume in said general area.

4. The pad as recited in claim 3 further comprising a third region of lateral grooves extending substantially across said substrate, said third region defining a second shoulder support area such that said first and second shoulder support area are generally symmetrical with respect to said tail support area.

5. The pad as recited in claim 4 wherein said resilient material comprises a foam material.

6. The pad as recited in claim 5 wherein:

(a) said first shoulder support area is approximately 13 inches wide and begins approximately 11.5 inches from a first end of said pad; and (b) said tail support area is approximately 11 inches wide and is approximately 9 inches from said first shoulder support area.

7. A pad for supporting a recumbent human being comprising:

(a) a substantially planar substrate comprised of a resilient foam material;

(b) a first region of lateral grooves extending substantially across said substrate, said first region defining a first shoulder support area;

(c) a second region of lateral grooves extending substantially across said substrate, said second region defining a tail support area; (d) a third region of grooves extending substantially across said substrate, said third region defining a second shoulder support area;

(e) a general support area formed in said substrate, said general support area comprising convolutions; and (f) a comparatively rigid peripheral region substantially surrounding said first and second regions of lateral grooves and said general support area.

8. A pad for supporting a recumbent human being comprising:

(a) a substantially planar substrate comprised of a resilient material;

(b) a first region of grooves extending lateral substantially across said substrate, said first region defining a first shoulder support area;

(c) a second region of grooves extending laterally substantially across said substrate, said second region defining a tail support area; and (d) wherein the remainder of said resilient substrate defines a general support area, said general support area comprising convolutions, the quantity of resilient material per unit volume in the general support area being grater than the quantity per unit volume in the shoulder and tail support areas.

9. The pad as recited in claim 8 further comprising a peripheral region formed about the periphery of said pad, the quantity of resilient material per unit volume on said peripheral region being greater than the quantity of resilient material per unit volume in said general area.

10. The pad as recited in claim 9 further comprising a third region of lateral grooves extending substantially across said substrate, said third region defining a second shoulder support area such that said first and second shoulder support areas are generally symmetrical with respect to said tail support area.

11. The pd as recited in claim 10 wherein said resilient material comprises a foam material.

12. The pad as recited in claim 11 wherein:

(a) said first shoulder support area is approximately 13 inches wide and begins approximately 11.5 inches from a first end of said pad; and (b) said tail support area is approximately 11 inches wide and is approximately 9 inches from said first shoulder support area.

* * * * *